US005188057A

United States Patent [19]

Ishikawa et al.

[11] Patent Number: 5,188,057

[45] Date of Patent: Feb. 23, 1993

[54] DEVELOPING APPARATUS

[75] Inventors: Masaaki Ishikawa, Hino; Michihisa Iguchi, Hachioji; Hiroshi Hashizume, Hino; Yasuo Fujii, Hachioji; Tetsuya Nakamura; Hirotaka Fukuyama, both of Hino; Seiji Arai, Hachioji; Koichiro Sato, Hino; Toshio Takagi, Higashihiroshima; Shuji Nishina, Kofu; Jiro Hukasawa, Shirane; Masatoshi Maruta; Seiichi Koizumi, both of Yamanashi, all of Japan

[73] Assignees: Kabushiki Kaisha Toshiba, Kawasaki; Shindengen Electric Manufacturing Co., Ltd., Tokyo; Yamanashi Electronics Co., Ltd., Yamanashi, all of Japan

[21] Appl. No.: 583,555

[22] Filed: Sep. 17, 1990

[30] Foreign Application Priority Data

| | | | |
|---|---|---|---|
| Sep. 18, 1989 | [JP] | Japan | 1-239902 |
| Sep. 19, 1989 | [JP] | Japan | 1-242830 |
| Sep. 17, 1990 | [JP] | Japan | 2-243892 |

[51] Int. Cl.[5] ..... G03G 15/08; G03G 15/00

[52] U.S. Cl. ..... 118/657; 355/253

[58] Field of Search ..... 355/251, 253, 245, 259; 118/657, 658, 653, 656, 651, 661

[56] References Cited

U.S. PATENT DOCUMENTS

| | | | |
|---|---|---|---|
| 4,436,413 | 3/1984 | Oka | 355/253 |
| 4,676,192 | 6/1987 | Yuge et al. | 118/658 |
| 4,865,936 | 9/1989 | Asanae et al. | 355/251 X |
| 4,916,492 | 4/1990 | Hoshika et al. | 355/253 |
| 4,987,452 | 1/1991 | Nakagawa et al. | 355/245 |
| 4,993,829 | 2/1991 | Naganuma et al. | 355/251 |
| 5,003,917 | 4/1991 | Toyoshi et al. | 118/653 |

FOREIGN PATENT DOCUMENTS

| | | | |
|---|---|---|---|
| 0008566 | 1/1982 | Japan | 118/657 |
| 0261761 | 11/1986 | Japan | 355/253 |
| 61-170767 | 12/1986 | Japan . | |
| 0160473 | 7/1987 | Japan | 355/253 |
| 0083753 | 4/1988 | Japan | 355/253 |
| 63-4278 | 6/1988 | Japan . | |
| 63-4282 | 6/1988 | Japan . | |

*Primary Examiner*—A. T. Grimley
*Assistant Examiner*—Robert Beatty
*Attorney, Agent, or Firm*—Finnegan, Henderson, Farabow, Garrett and Dunner

[57] ABSTRACT

A developing apparatus including a hopper storing toner and carrier and a roller disposed in an opening of the hopper. A carrier stopper is provided on a front wall of the hopper proximate the opening having an arced surface concentrically opposing an upper portion of the roller. Thus, a blend layer volume is formed in a first space between the carrier stopper and the roller for storing a blended layer of carrier and toner such that the carrier stopper prevents carrier from scattering outside the blend layer volume and the conjunctional effect of rotating the roller and of the magnetic force of the rotary magnets in the roller blends the carrier and toner stored in the blended layer. A sub-hopper, proximate the blend layer volume, is also formed by a second space between the carrier stopper and a lateral bottom wall of the hopper for storing toner to be provided to the blended layer.

18 Claims, 5 Drawing Sheets

DEVELOPING APPARATUS

BACKGROUND OF THE INVENTION

1. Field of the Invention

The present invention relates to a developing apparatus which is available for an electrophotographic apparatus like a laser beam printer and executes a developing process in the electrophotographic processes.

2. Description of the Related Art

As a developing method in the developing process using an electrophotographic recording apparatus, there is such a method which stores magnetic toner in the periphery of a toner/carrier roller in a hopper storing magnetic toner and magnetic carrier to blend the magnetic toner with the magnetic carrier at a position close to the toner/carrier roller.

According to any conventional developing apparatus, the toner/carrier roller and a photoconductive drum are installed in parallel with each other. The toner/carrier roller is composed of a cylindrical sleeve made of non-magnetic material and a rotatable magnet which is coaxially installed inside of the sleeve so that the sleeve and the magnet can rotate in the direction opposite from each other. The toner/carrier roller is disposed at the opening of the hopper. The hopper stores magnetic toner and magnetic carrier. Initially, carrier is stored in the vicinity of the toner/carrier roller before adhering itself to the periphery of the toner/carrier roller. Toner gradually mixes itself into carrier before being held by the toner/carrier roller.

According to the above conventional structure, the carrier is gradually moved to the upper position of the hopper by the rotation of the sleeve before eventually being dispersed all over the hopper. Once the carrier fully disperses on the hopper, the blend ratio (toner density) between the toner held on the toner/carrier roller and the carrier varies, thus eventually generating uneven density of the recorded image.

Although the magnetic carrier functions to clean the surface of the sleeve, once the carrier itself disperses, the sleeve cannot be well cleaned. This in turn causes the toner to solidify on the sleeve and eventually lowers the quality of the recorded image.

SUMMARY OF THE INVENTION

The object of the invention is to provide an improved developing apparatus which, by constantly holding carrier in the vicinity of the toner/carrier roller, maintains the toner concentration and the amount of the carrier on the toner/carrier roller so that recording of quality images can stably be executed.

According to the invention, a carrier stopper is provided inside of the hopper by way of facing the toner/carrier roller at a position close to the toner outlet of the hopper so that the carrier can be stored in the developing area on the toner/carrier roller.

Furthermore, according to the invention, the volume of the space formed between the carrier stopper and the toner/carrier roller and the amount of the carrier stored in this space are respectively set to specific values so that the blend ratio between the toner and the carrier on the toner/carrier roller remains in a range of from 20% to a maximum of 90%.

By virtue of the provision of those means mentioned above, the flow of carrier caused by the rotation of the toner/carrier roller is suppressed by the carrier stopper, and thus the flow of carrier is virtually confined in the space between the toner/carrier roller and the carrier stopper. As a result, scatter of the carrier all over the hopper can securely be minimized.

Furthermore, since the volume of space formed between the carrier stopper and the toner/carrier roller and the amount of carrier stored in this space are respectively set to specific values so that the blend ratio between the magnetic toner and the magnetic carrier on the toner/carrier roller remains in a range of from 20% to a maximum of 90%, owing to the function of the carrier stopper, scatter of the carrier all over the hopper can be minimized. As a result, the blend ratio between the magnetic toner and the magnetic carrier on the toner/carrier roller can constantly be held in a range of from 20% to 90%.

Additional objects and advantages of the invention will be set forth in the description which follows, and in part will be obvious from the description, or may be learned by practice of the invention. The objects and advantages of the invention may be relaized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
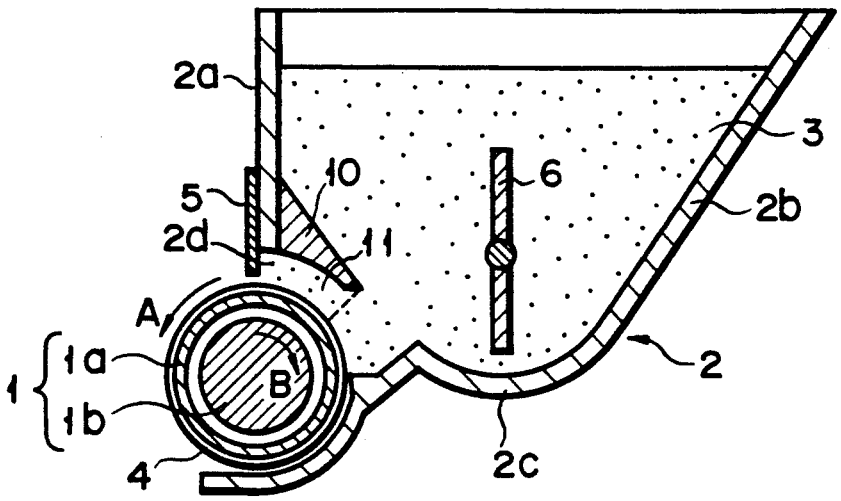
FIG. 1 presents a sectional view of the developing apparatus according to an embodiment of the invention.

According to the developing apparatus shown in FIG. 1, a toner/carrier roller 1 is installed in parallel with a photoconductive drum (not shown). The toner/carrier roller 1 comprises a cylindrical sleeve 1*a* made of non-magnetic material and a rotary magnet 1b which is coaxially provided inside of the sleeve 1a. The sleeve 1a rotates itself in the arrowed direction A, whereas the magnet 1b rotates itself in the arrowed direction B. The toner/carrier roller 1 is disposed in the opening of a hopper 2. In this case, part of the toner/carrier roller 1 is positioned inside of the hopper 2.

The hopper 2 has a front vertical wall 2a, an inclined rear wall 2b, and a bottom wall 2c. An opening is provided between the bottom end of the front vertical wall 2a and the tip of the bottom wall 2c. In other words, the opening is provided on the lateral surface of the bottom of the hopper 2. The bottom wall 2c has a semi-circular recess wall portion and a guide wall portion connected to the recess wall and extending along the roller 1. The hopper 2 stores magnetic toner (hereinafter merely called toner) 3 and magnetic carrier (hereinafter merely called carrier) 4.

A blade 5 is provided for toner outlet 2d of the hopper 2. The blade 5 is secured to the front vertical wall 2a. When the toner/carrier roller 1 rotates, the blade 5 maintains the thickness of the layer of the toner 3 and carrier 4 constant while these are led out of the hopper 2 in adhesion to the toner/carrier roller 1. A carrier stopper 10 is secured to the inner wall surface of the front vertical wall 2a at a position close to the toner outlet 2d of the hopper 2. A surface of the carrier stopper 10 in opposition from the toner/carrier roller 1 has arced shape in concentricity with the toner/carrier roller 1, whereas the surface opposite from the arced surface inclines. The inclined surface is provided with an angle of rest for allowing the toner 3 to easily fall downward.

Space (mixing area) 11 is formed below the carrier stopper 10, where this space 11 is surrounded by the arced surface of the carrier stopper 10, the toner/carrier roller 1, and the blade 5, respectively. The carrier 4 is stored in this space 11.

Either a toner transferring member or an agitator 6 is provided on the halfway of the hopper 2 and on the semi-circular recess wall portion in order to transfer the toner 3 from the semi-circular recess wall portion to the toner/carrier roller 1.

In the initial condition of the developing apparatus, as shown by broken line of FIG. 1, carrier 4 is stored in space 11 near the toner/carrier roller 1, while it also adheres to the peripheral surface of the toner/carrier roller 1. Toner 3 mixes into carrier 4 little by little before being held on the surface of the toner/carrier roller 1.

When operating the developing apparatus having the structure mentioned above, as soon as the toner/carrier roller 1 starts to rotate to execute development, carrier 4 in the space 11 is moved upward by the rotation of the sleeve 1a. However, due to presence of the carrier stopper 10, the carrier 4 flows in a range of the space 11 without scattering itself to other regions of the hopper 2. As a consequence, the developing apparatus can maintain the amount of the carrier in the space 11 at almost a constant level.

Figure 2:
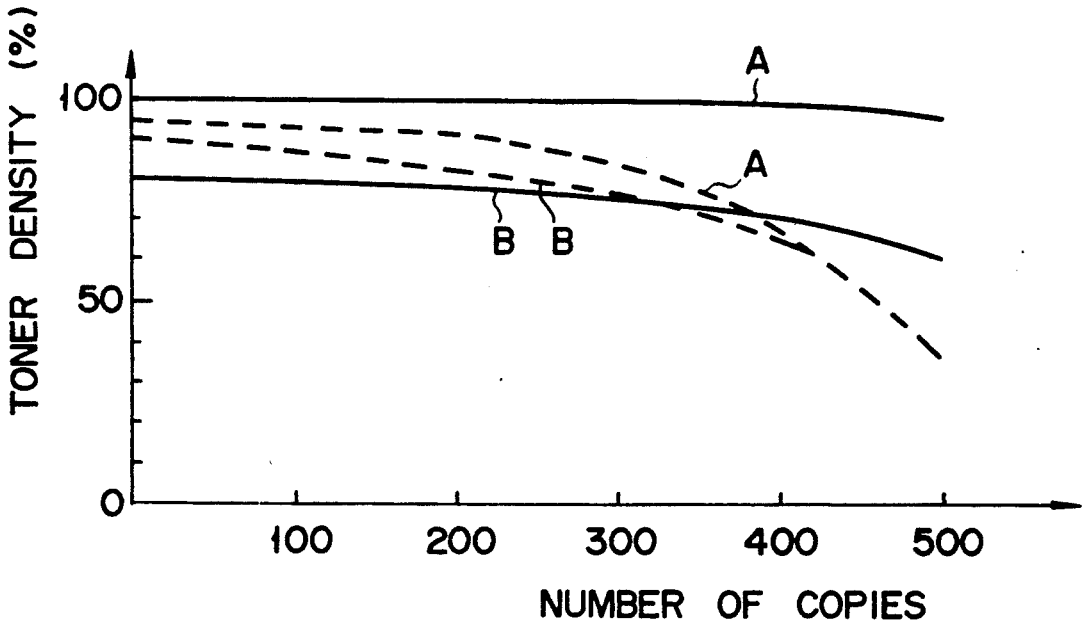
FIG. 2 presents a graphic chart designating the relationship between the number of processed papers and the toner concentration.

FIG. 2 graphically designates the relationship between the number of copies and the toner density. Solid line designates the data yielded from the developing apparatus of the invention, whereas broken line designates the data yielded from a conventional developing apparatus. Graph A designates the data of regions other than the space 11 of the hopper 2. Graph B designates the data on the toner/carrier roller 1. As is apparent from FIG. 2, compared to the conventional developing apparatus shown by broken line, the developing apparatus embodied by the invention shown by solid lines causes little variation in the toner density. The value of the toner density is calculated by an expression shown below.

$$\frac{\text{weight of toner}}{\text{weight of toner + weight of carrier}} \times 100$$

Since the amount of the carrier 4 in the space 11 can be held constant, the toner density does not vary at all, thus preventing image density from being unevenly distributed. Furthermore, since the amount of the carrier 4 on the periphery of the toner/carrier roller 1 virtually remains constant, cleaning function cannot be decreased. This in turn prevents picture quality from being degraded by occurrence of solidified toner.

Figure 3:
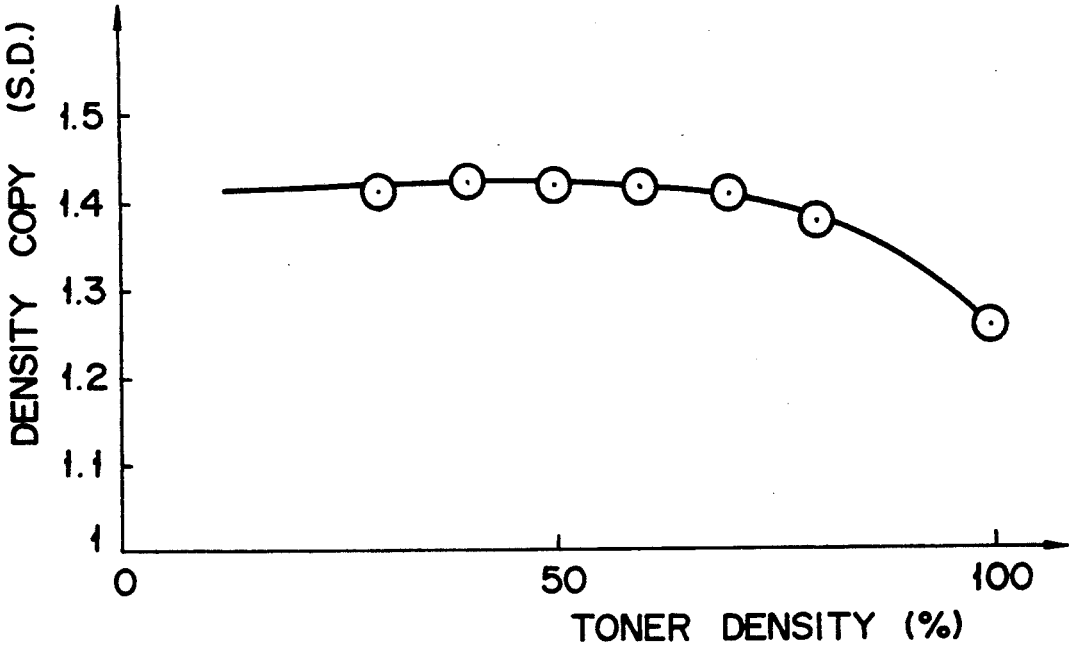
FIG. 3 presents a graphic chart designating the relationship between the toner concentration on the developing area on the toner/carrier roller and the density of the recorded image.

As is clear from the relationship between the toner density on roller 1 and the density of the recorded picture shown in FIG. 3, substantial copy density can be yielded when the toner on the toner/carrier roller 1 in the space 11 has a density of from 20% to 90%. This is because, if the toner density were less than 20%, instead of the toner 3, the carrier 4 adheres to electrostatic latent image formed on the photoconductive drum (not shown). On the other hand, if the toner density were more than 90%, due to excessive presence of the toner 3, the toner 3 may solidify or excessively adhere to the photoconductive drum due to insufficient cleaning function of the carrier 4.

Taking the above into account, it is desired that the following conditions be realized. Assume that the space 11 has area S surrounded by an imaginary perpendicular line extended from the tip of the carrier stopper 10 to the center of the toner/carrier roller 1, the toner/carrier roller 1, the blade 5, and the carrier stopper 10, and the toner/carrier roller 1 has radius "r", where the area of the space 11 is determined by an expression $1r \leqq S \leqq 10r$. It is desired that the amount of the carrier 4 on the developing area on the toner/carrier roller 1 be determined at a value so that the toner density on the developing area remains in a range of from 20% to 90%. Consequentially, if the radius "r" of the toner/carrier roller 1 is 9 mm and the initial value of the carrier 4 about 20 g, the toner density can be adjusted from 65% to a maximum of 80%.

If the toner density on the developing area on the toner/carrier roller 1 is adjusted to from 40% to a maximum of 70%, the developing apparatus can yield a more distinct image.

As mentioned above, according to the above embodiment, the developing apparatus can maintain the toner density constant while suppressing scatter of the carrier 4, and as a result, the developing apparatus of the invention can perform development process under constantly optimal condition. Furthermore, since the toner density on the toner/carrier roller 1 can be held constant, by optimizing the area of the space 11 and the amount of the carrier 4, the toner density on the toner/carrier roller 1 can constantly be held in a range of from 20% to a maximum of 90%, thus allowing the developing apparatus to stably develop distinct image all the time.

Figure 4:
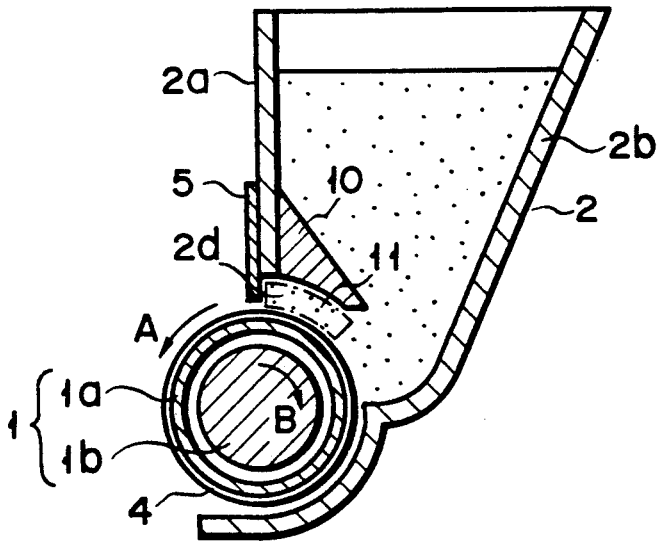
FIG. 4 presents a sectional view of the developing apparatus according to a modification from the embodiment shown in FIG. 1.

If the developer transferring member 6 were not provided in the hopper 2 in the execution of the above embodiment, as shown in FIG. 4, the inclined wall 2b of the hopper 2 may be provided by way of extending itself from the bottom along the bottom of the toner/- carrier roller 1. In this case, the toner is supplied to the toner/carrier roller 1 by effect of own weight. The carrier stopper 10 may be installed to a position slightly apart from the front wall 2*a* of the hopper 2.

Next, referring to FIGS. 5 and 6, another embodiment of the invention is described below.

Figure 5:
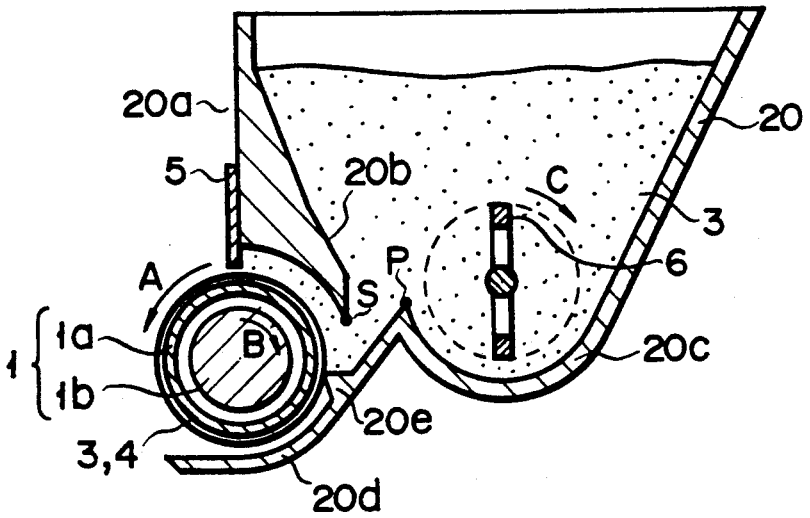
FIG. 5 presents a sectional view of a developing apparatus according to another embodiment of the invention.

Referring now to FIG. 5, a front wall 20*a* of a hopper 20 storing toner, in other words, the wall 20*a* above a sleeve 1*a* has a projection or carrier stopper 20*b* having arc-shape bottom along the circumferential surface of the sleeve 1*a*. Bottom wall of the hopper 20 has the first wall portion 20*c* having arced sectional surface and the second wall portion 20*d* projecting itself from the tip of the first portion by way of covering the lower portion of the sleeve 1*a*. In consequence, as shown in FIG. 5, the conjunctional portion of the first wall portion 20*c* and the second wall portion 20*d* has inverse V-shaped sectional surface. The second wall portion 20*d* on the lateral side of the sleeve 20 has an incline portion having an angle more than the angle that allows the toner to easily fall downward by effect of own weight, in other words, it has an angle more than the angle of rest. A projection 20*e* having flat upper surface is provided on the incline portion of the second wall portion.

A certain interval is provided between the bottom surface of the carrier stopper 20*b* and the sleeve 1*a* so that the space 11 can be formed. It is desired that the sectional area S of the space 11 be in a specific range determined by an expression $1.0r \leqq S \leqq 10.0r$ when the sleeve 1*a* has radius "r". Specific interval is provided between the tip (point S in FIG. 5) of the carrier stopper 20*b* and the bottom surface (plane of the projection 20*e*) of the hopper 20. The tip end (point S) of the projection 20*b* is set to a position lower than the peak (point P) of the conjunctional point of the first and second wall portions 20*c* and 20*d* of the hopper 20.

Next, operation of the developing apparatus shown in FIG. 5 is described below.

Figure 6:
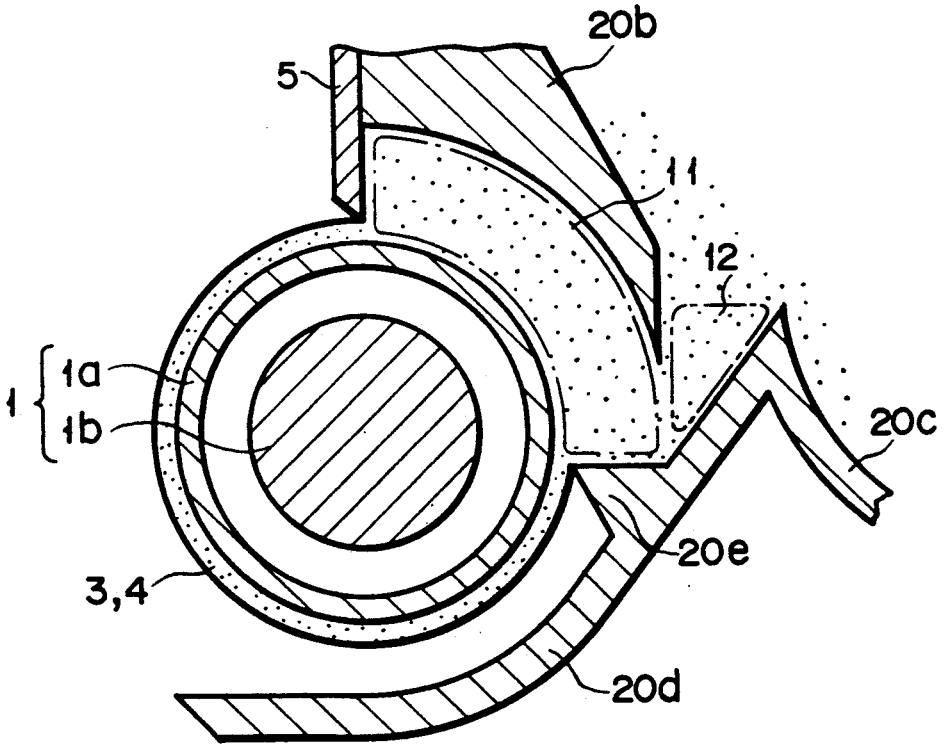
FIG. 6 presents an enlarged view of peripheral portion of the toner carrier roller shown in FIG. 5.

According to the enlarged view of the peripheral portions of the toner/carrier roller 1 shown in FIG. 6, when initial condition is entered, the predetermined amount of the carrier 4 and the predetermined amount of the toner 3 are mixed together so that the toner density can reach the predetermined value in the space 11. The blend of the toner 3 and the carrier 4 stored in the space 11 is hereinafter called the layer of blended toner and carrier in the description.

In order to record distinct images, it is desired that the volume of space 11 and the amount of the carrier be optimized and the toner density be adjusted from 20% to 90%, preferably to a range from 40% to 70%. Supplementary toner 3 is stored in the hopper 20. When this condition is present, the space 11 is filled with the toner and the carrier. As a result, the toner 3 to be supplied from the hopper 20 to the space 11 cannot flow into the space 11, and thus, it is provisionally stored in space 12 (hereinafter called sub-hopper) formed between the carrier stopper 20*b* and the second wall portion 20*d* at the bottom of the hopper 20. In other words, the sub-hopper 12 functions as a provisional pool for storing the toner. The incline portion of the second wall portion 20*d* on the lateral side of the sleeve 1*a* makes up the bottom of the sub-hopper 12. Since the second wall portion 20*d* has an incline portion having an angle more than the rest angle of the toner 3, the bottom of the sub-hopper 12 makes up an inclined surface having an angle more than the rest angle of the toner 3.

When the developing apparatus performs image developing operation, the toner in space 11 is consumed to cause the toner 3 in the sub-hopper 12 to fall on the plane surface of the projection 20*e*. In other words, when the toner in the space 11 is consumed, the supplementary toner in the sub-hopper 12 is supplied onto the plane surface of the projection 20*e*. In this case, the sleeve 1*a* rotates itself in the direction A, whereas the magnetic roller 1*b* rotates itself in the direction B, and thus, due to combined function of the rotation of the sleeve 1*a* and the magnetic force of the magnetic roller 1*b*, the toner 3 delivered to the projection 20*e* is led into space 11 and mixed with the carrier 4. Consequentially, the supplementary toner 3 and the carrier 4 are moved from the up-stream to the down-stream in space 11 and accordingly mixed together so that the blend ratio has a predetermined (optimum) value in the vicinity of the toner/carrier roller.

The blend layer is externally delivered through the clearance between the sleeve 1*a* and the blade 5.

As mentioned above, according to the second embodiment, the toner 3 is indirectly supplied from the hopper 20 to the toner/carrier roller 1 via the sub-hopper 12. Furthermore, since the toner 3 is not directly supplied from the hopper 20 to the toner/carrier roller 1, but the toner/carrier roller 1 takes up the toner 3 availing of magnetic force of the magnetic roller, the toner 3 can stably be supplied to the toner/carrier roller 1 all the time.

Blending of the toner 3 with carrier 4 and the transfer of the layer of blended toner and carrier are performed in the space 11 apart from the other space of the hopper 20 storing supplementary toner 3, so that carrier 4 is prevented from moving itself from space 11 to the other space inside of the hopper 20. In other words, the carrier 4 does not scatter at all.

Furthermore, according to the second embodiment, since the tip end (point S shown in FIG. 5) of the projection 20*b* is at a position lower than the peak (point P) of the conjunctional portion of the first and second portions 20*c* and 20*d* of the hopper 20, and that portion of the second portion 20*d* of the hopper 20 which makes up the bottom of the sub-hopper 12 has an incline angle which is more than the rest angle of the toner 3, the toner 3 cannot forcedly be led into the sub-hopper 12 by the agitator 6, but instead, the toner is led into the sub-hopper 12 by effect of own weight. As a result, the toner 3 can stably be supplied to the space 11.

The developing apparatus is provided with the projection 20*e*. Since the toner 3 supplied to the top surface of this projection 20*e* is blended with the carrier 4 by effect of the rotation of the sleeve 1*a* and magnetic force of the magnetic roller 1*b*, the toner 3 can securely be led into the space 11. The projection 20*e* prevents the blend layer from reversing its flow.

By virtue of those functions mentioned above, the amount of the toner 3 and the amount of the carrier 4 on the toner/carrier roller 1 can respectively be held constant, and as a result, the toner density on the toner/carrier roller 1 can always be held constant. In consequence, image density remains stable, and yet, images always be recorded under optimal condition, thus eventually yielding very distinct pictures.

Using a developing apparatus having a 18 mm diameter for sleeve 1*a* and a 260 mm developing width, inventors carried out trials by applying 23 grams of the carrier 4. As a result, the toner density was accordingly held at 65%.

Figure 7:
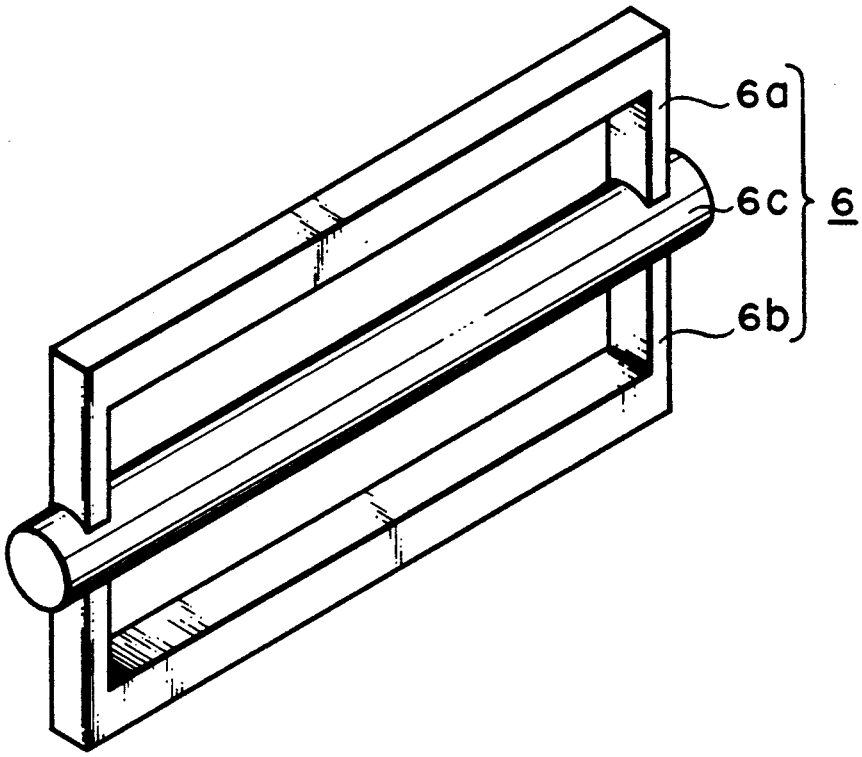
FIG. 7 presents a perspective view of an agitator having general configuration.

The agitator 6 has the structure shown in FIG. 7. Concretely, the agitator 6 has a pair of rectangular toner transferring members 6*a* and 6*b* whose both ends are vertically folded and secured to a cylindrical shaft 6*c* in opposition from each other. As shown in FIG. 5, when the agitator 6 rotates itself in the arrowed direction C inside of the hopper 20, the toner 3 stored in the hopper 20 is stirred and then delivered to the sub-hopper 12.

Figure 8:
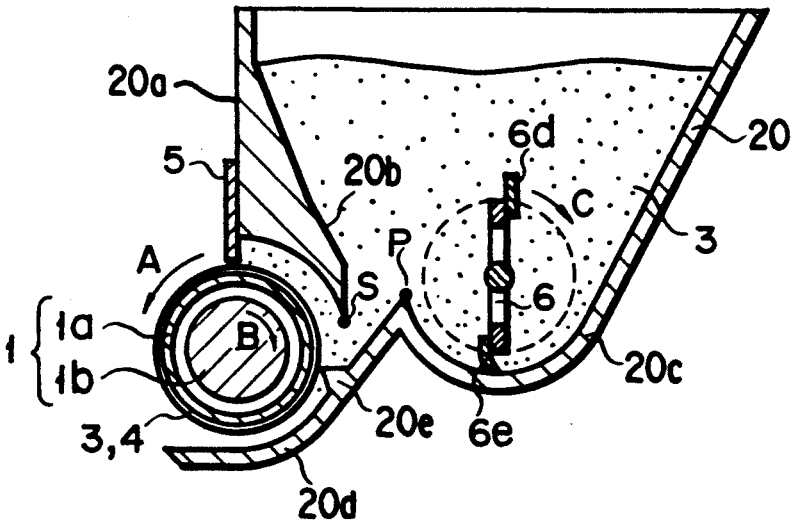
FIG. 8 presents a sectional view of the developing apparatus according to a modification from the embodiment shown in FIG. 5.
Figure 9:
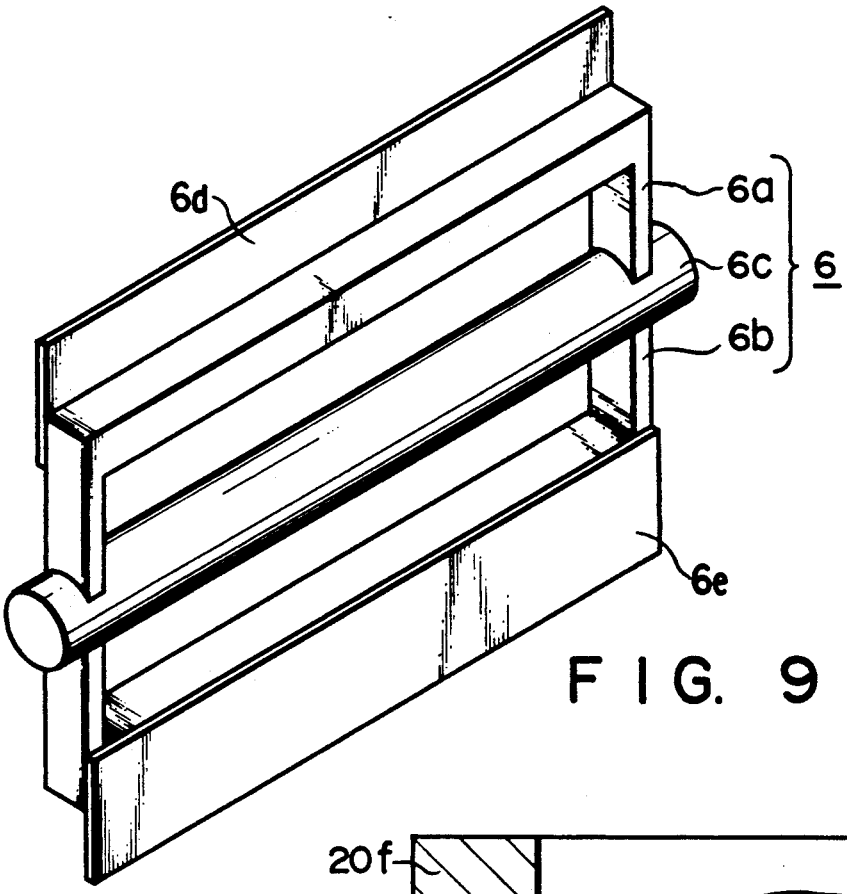
FIG. 9 presents a perspective view of the agitator of the developing apparatus shown in FIG. 8.

According to another embodiment shown in FIG. 8, (which uses an agitator shown, for example, in FIG. 9); a pair of elastic members 6*d* and 6*e* having a length sufficient to come into contact with the first wall portion 20*c* (the bottom surface of the hopper 20) of the hopper 20 are respectively secured to the toner transferring members 6*a* and 6*b*. These elastic members 6*d* and 6*e* are made from for example nylon impregnated with rubber and are respectively secured to the surfaces of the toner transferring members 6*a* and 6*b* with a powerful adhesive agent.

These elastic members 6*d* and 6*e* secured to the agitator 6 scoop up the toner 3 from the bottom of the hopper 20 to the sub-hopper 12, (shown in FIG. 6) and thus, even the least amount of the toner 3 remaining in the hopper 20 can securely be supplied to the sub-hopper 12. As a result, the toner 3 can stably be supplied from the sub-hopper 12 to the space 11, (shown in FIG. 6) thus preventing the toner 3 from varying its density.

According to the embodiment shown in FIG. 8, the length between the axis of the shaft 6*c* of the agitator 6 and the tip ends of the elastic members 6*d* and 6*e* is longer than the length between the axis of the shaft 6*c*and the first wall portion 20*c* of the hopper 20. This causes the tip ends of the elastic members 6*d* and 6*e* to projectively rotate themselves above the sub-hopper 12 to stir the toner 3 above the sub-hopper 12. This in turn prevents the toner 3 above the sub-hopper 12 from agglomeration. For example, there is 3 mm of difference (projection) in the length between the axis of the shaft 6*c* and the tip ends of the elastic members 6*d* and 6*e* and the length between the axis of the shaft 6*c* and the first wall portion 20*c* of the hopper 20. However, the optimal value of this difference varies according to the shape, size, and frequency of rotation of the agitator 6.

Figure 10:
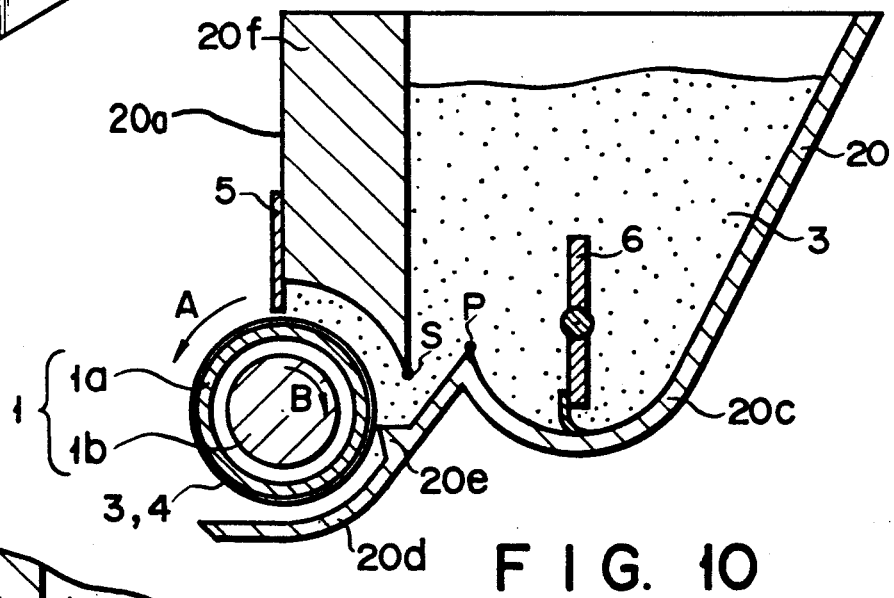
FIG. 10 presents a sectional view of the developing apparatus according to a still another embodiment.

Referring to the above embodiment, a projection 20*b* having an inclined surface is provided for the front wall 20*a*. Instead, as shown in FIG. 10, the front wall 20*a* may also be formed of a thick plate member 20*f* having a vertical surface. In this case, since mechanical strength of the front wall 20 grows, stability of the blade 5 secured to the front wall 20 is promoted, and as a result, the blend layer composed of developer and carrier can evenly be supplied to the toner/carrier roller 1.

Figure 11:
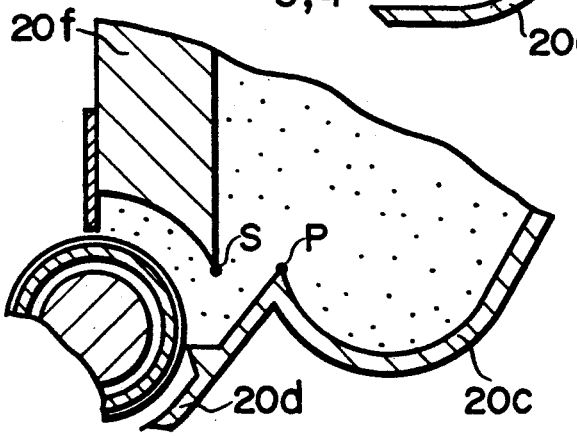
FIG. 11 presents a sectional view of the developing apparatus according to a still further another embodiment.

In the event that the agitator 6 is not provided for the developing apparatuses shown in FIGS. 5 and 8, the hopper 20 may be of the structure as per the embodiment shown in FIG. 4. It is desired that the bottom of the sub-hopper 12 be provided with an incline surface having an angle more than the rest angle of the toner 3. Nevertheless, it is not always necessary for this embodiment to provide an incline surface in excess of the rest angle of the toner 3. For example, either a horizontal surface or an incline surface having an angle less than the rest angle of the toner 3 may also be provided. It is also admissible to conjoin an incline surface more than the rest angle of the toner 3, another incline surface less than the rest angle of the toner 3 and a horizontal surface together. Further, the tip end S of the projection 20*f* may be juxtaposed the peak P of the conjunctional portion of the first and second wall portions 20*c* and 20*d* as shown in FIG. 11.

According to the invention, a carrier stopper which projects itself from the interior of the hopper near the toner outlet of this hopper and faces the toner/carrier roller is provided. Since magnetic carrier is stored in space formed between the carrier stopper and the toner/carrier roller, the carrier is constantly held near the toner/carrier roller. This in turn allows the toner density and the amount of the carrier on the toner/carrier roller to be held constant. As a result, quality image can stably be recorded.

Furthermore, the apparatus of the invention correctly adjusts the volume of space formed between the carrier stopper and the toner/carrier roller and the amount of magnetic carrier stored in this space so that the blend ratio of the toner and the carrier on the toner/carrier roller can remain in a range from 20% to a maximum of 90%. As a result, due to provision of the carrier stopper, scatter of the carrier all over the hopper surface can be minimized, and yet, the blend ratio of the toner and the carrier on the toner/carrier roller can constantly be held in a range from 20% to a maximum of 90%, thus making it possible for the system to stably develop distinct image all the time.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A developing apparatus comprising: hopper means for storing toner and carrier including:

a front wall, an opposing rear inclined wall, and a bottom wall extending from the rear inclined wall towards the front wall and forming an opening between a bottom edge of the front wall and an edge of the bottom wall;

carrier/toner roller means disposed in the opening such that part of the carrier/toner roller means extends into the hopper means for transferring toner and carrier, said carrier/toner roller means comprising:

an inner rotary magnet, and an outer rotary sleeve member coaxially provided on the inner rotary magnet;

a carrier stopper provided on the front wall proximate the opening, said carrier stopper having an arced surface concentrically opposing an upper portion of the part of the carrier/toner roller means extending into the hopper means across a blend layer space, and a flat inclined surface opposing the arced surface descending from the front wall at a predetermined angle sufficient to direct toner impacting the inclined surface towards the bottom wall;

a blend layer volume formed in the blend layer space between the carrier stopper and the carrier/toner roller means for storing a blended layer of carrier and toner, wherein the carrier stopper prevents carrier from scattering outside the blend layer volume and the conjuctional effect of rotating the rotary sleeve member and magnetic force of the rotary magnet blends the carrier and toner stored in the blended layer; and a sub-hopper formed between the carrier stopper and the bottom wall proximate the blend layer volume, for storing toner to be provided to the blended layer.

2. The developing apparatus according to claim 1, wherein the bottom wall comprises:

a first wall portion proximate the rear inclined wall; and a second wall portion extending from the opening towards the front wall.

3. The developing apparatus according to claim 2, wherein the second wall portion of the bottom wall comprises:

an inclined portion proximate the first wall portion descending towards the opening at an angle sufficient to direct toner towards the opening; and a flat projection portion provided between the inclined portion and the opening;

wherein the sub-hopper is formed in a space bounded by the carrier stopper, the inclined portion of the second wall portion, and the flat projection portion of the second wall portion.

4. The developing apparatus according to claim 2, wherein the second wall portion concentrically opposes a lower portion of the part of the carrier/toner roller means extending into the hopper.

5. The developing apparatus according to claim 1, further comprising transferring means provided in the hopper means for directing toner towards the carrier/-toner roller means.

6. The developing apparatus according to claim 5, wherein the transferring means is a rotatable agitator.

7. The developing apparatus according to claim 6, wherein the agitator includes a cylindrical shaft and rectangular members secured to the shaft in opposition to each other.

8. The developing apparatus according to claim 7, the agitator further comprising elastic members respectively secured to each one of the rectangular members and projecting outward from each rectangular member.

9. The developing apparatus according to claim 1, wherein the toner is substantially magnetic toner and the carrier is magnetic carrier.

10. A developing apparatus comprising:

hopper means for storing toner and carrier including:

a front wall, an opposing rear inclined wall, and a bottom wall extending from the rear inclined wall towards the front wall and forming an opening between a bottom edge of the front wall and an edge of the bottom wall;

carrier/toner roller means disposed in the opening such that part of the carrier/toner roller means extends into the hopper means for transferring toner and carrier, said carrier/toner roller means comprising:

an inner rotary magnet, and an outer rotary sleeve member coaxially provided on the inner rotary magnet;

a carrier stopper integrally formed as part of the front wall, said carrier stopper having an arced surface concentrically opposing an upper portion of the part of the carrier/toner roller means extending into the hopper means across a blend layer space, and a flat inclined surface opposing the arced surface descending towards the bottom wall at a predetermined angle sufficient to direct toner impacting the inclined surface towards the bottom wall;

a blend layer volume formed in the blend layer between the carrier stopper and the carrier/-toner roller means for storing a blended layer of carrier and toner, wherein the carrier stopper prevents carrier from scattering outside the blend layer volume and the conjunctional effect of rotating the rotary sleeve member and magnetic force of the rotary magnet blends the carrier and toner stored in the blended layer; and a sub-hopper formed between the carrier stopped and the bottom wall proximate the blend layer volume for storing toner to be provided to the blended layer.

11. The developing apparatus according to claim 10, wherein the bottom wall comprises:

a first wall portion proximate the rear inclined wall; and a second wall portion extending from the opening towards the front wall and concentrically opposing a lower portion of the part of the carrier/toner roller means extending into the hopper.

12. The developing apparatus according to claim 11, wherein the second wall portion of the bottom wall comprises:

an inclined portion proximate the first wall portion descending towards the opening at an angle sufficient to direct toner towards the opening; and a flat projection portion provided between the inclined portion and the opening.

13. The developing apparatus according to claim 12, wherein the flat inclined surface of the carrier stopper is formed by a thick plate member truncated in a vertical surface descending from a downward edge of the flat inclined surface to a downward edge of the arced surface of the carrier stopper;

wherein the sub-hopper is formed in a space bounded by the vertical surface of the carrier stopper, the inclined portion of the second wall portion, and the flat projection portion of the second wall portion; and wherein the blend layer volume is formed in the blend layer space bounded by the arced surface of the carrier stopper and the flat projection portion of the second wall portion.

14. The developing apparatus according to claim 10, further comprising transferring means provided in the hopper means for directing toner towards the carrier/-toner roller means.

15. The developing apparatus according to claim 14, wherein the transferring means is a rotatable agitator.

16. The developing apparatus according to claim 15, wherein the agitator includes a cylindrical shaft and rectangular members secured to the shaft in opposition to each other.

17. The developing apparatus according to claim 16, the agitator further comprising elastic members respectively secured to each one of the rectangular members and projecting outward from each rectangular member.

18. The developing apparatus according to claim 10, wherein the toner is substantially magnetic toner and the carrier is magnetic carrier.

* * * * *